United States Patent [19]

Lettner et al.

[11] 4,287,861

[45] Sep. 8, 1981

[54] RECIPROCATING INTERNAL-COMBUSTION ENGINE

[75] Inventors: Kurt Lettner; Eugen Egger; Rudolf Unger, all of Steyr, Austria

[73] Assignee: Steyr-Daimler-Puch Aktiengesellschaft, Vienna, Austria

[21] Appl. No.: 19,323

[22] Filed: Mar. 9, 1979

[51] Int. Cl.[3] ..... F02B 77/13

[52] U.S. Cl. ..... 123/198 E; 123/195 C; 181/204

[58] Field of Search ..... 123/195 C, 195 A, 195 S, 123/198 E; 181/204

[56] References Cited

U.S. PATENT DOCUMENTS

| | | | |
|---|---|---|---|
| 3,464,398 | 9/1969 | Scheiterlein et al. | 181/204 X |
| 3,880,134 | 4/1975 | Thien et al. | 123/195 C |
| 3,991,735 | 11/1976 | Horstmann | 123/195 C |
| 4,071,008 | 1/1978 | Skatsche et al. | 123/195 C X |
| 4,126,115 | 11/1978 | List et al. | 181/204 X |
| 4,137,794 | 2/1979 | Horstmann | 181/204 X |
| 4,186,714 | 2/1980 | Danckert et al. | 123/195 C |
| 4,203,409 | 5/1980 | Fachbach et al. | 123/195 A |
| 4,213,439 | 7/1980 | Feichtinger et al. | 123/195 S |

*Primary Examiner*—Charles E. Phillips
*Attorney, Agent, or Firm*—Kurt Kelman

[57] ABSTRACT

In a reciprocating internal-combustion engine, a power unit comprises cylinders 1, cylinder heads 2, pistons, connecting rods, a crankshaft and crankshaft bearings. Soundproofing supporting members mount the ends of the power unit in an outer pan 7 which is connected to a flywheel housing 8. Soundproofing supporting members 12, 12*a,* 13 are coaxial with the crankshaft and center the power unit and hold it against substantial axial movement in the outer pan. An oil seal 14 is fitted between the power block and the top rim of the outer pan.

9 Claims, 2 Drawing Figures

Figure 1:
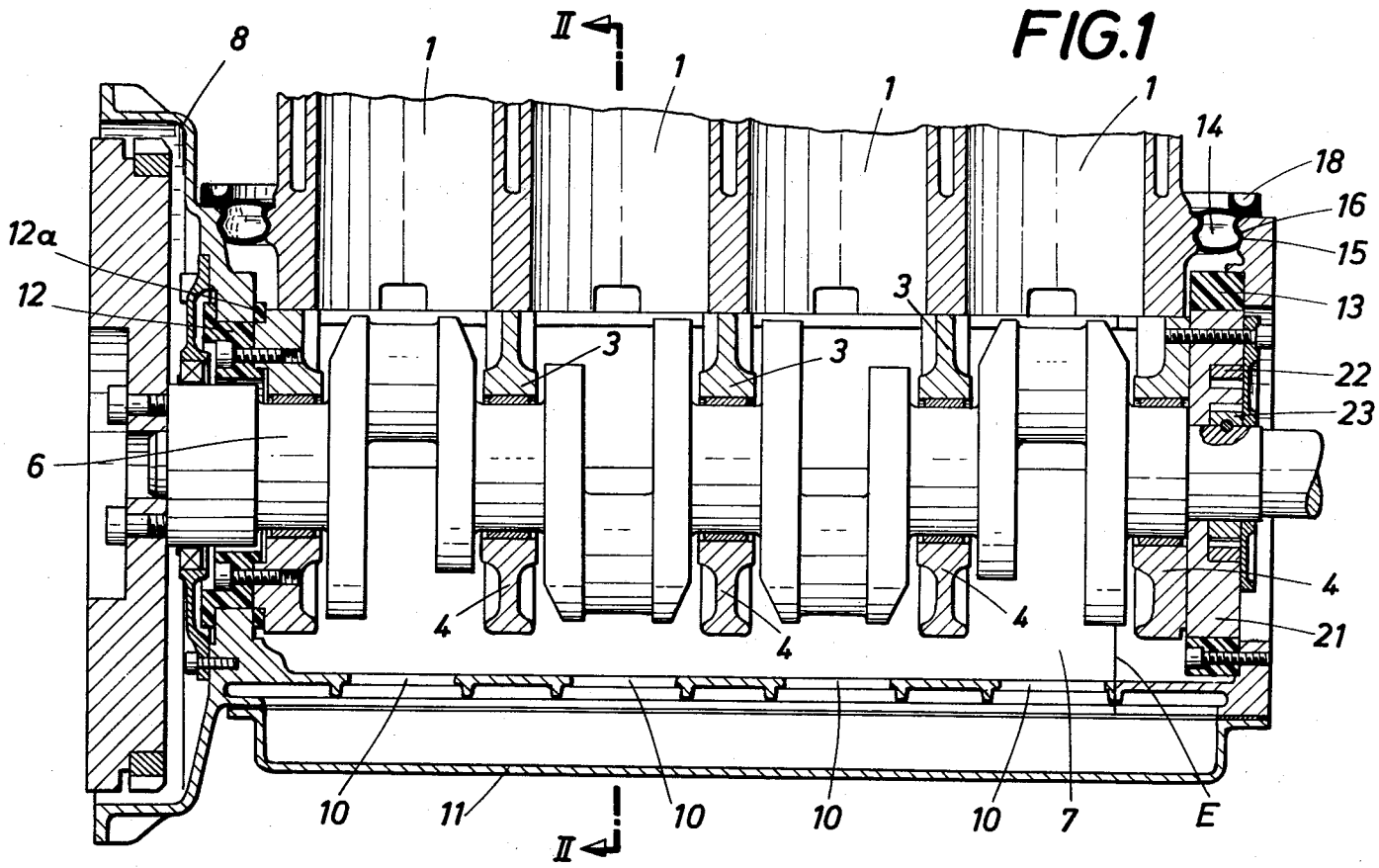

18
16
15
13
22
23
4
21
14
1
E
7
10
3
8
12a
12
6
II
11

RECIPROCATING INTERNAL-COMBUSTION ENGINE

This invention relates to a reciprocating internal-combustion engine in which cylinders, cylinder heads, pistons, connecting rods, a crankshaft and crankshaft bearings constitute a power unit soundproofing supporting members mount the power unit in an outer pan which is connected to a flywheel housing.

Because the power unit is separate from the outer pan and soundproofing supporting elements are provided between the power unit and the outer pan, the sound waves which originate in the combustion chambers in the cylinders are kept from the outer pan and a radiation of sound is suppressed. In a reciprocating internal-combustion engine which is known from Opened German Specification No. 2,612,182, the power unit comprises a peripheral side frame disposed at one-half of the height of the cylinders and at said side frame is supported on the flat upper surface of the outer pan with an annular element, which insulates against structure-borne sound and constitutes also an oil seal between the outer pan and the power unit. The top portion of the power unit comprises the cylinder heads and protrudes from the outer pan and can be shielded by a sound-insulating hood. The sound-insulating element cannot be sound-insulating unless it is soft. On the other hand it consists of a supporting element and is loaded not only by the mass of the power unit but also by the engine torque, against which the outer pan must react. These influences result in considerable unfavorable deflections of the center of the crankshaft in a radial direction. The forces and torques which are due to the inertia of the crank mechanisms may also result in resonance and in increased deflections of the crankshaft because the entire power unit suspended in the outer pan can swing more or less like a pendulum. Finally the power unit is not sufficiently held against axial movement, e.g., when thrust forces are exerted by the clutch. Because the crankshaft and also the flywheel can move in all directions, they cannot be connected directly, in proved manner, to the other parts of the drive mechanism, e.g., to the clutch, but a relatively complicated, flexible intermediate coupling is provided, which adds to the bulk, structural expenditure and weight of the engine. Besides, an additional flexible seal must be provided between the outer pan and that end of the crankshaft which carries flywheel. The other end of the crankshaft is not accessible at all so that such expensive seal need not be provided there. As a result, that end of the crankshaft cannot be used in the usual, simple manner for driving auxiliary machines disposed outside the outer pan but these machines must be mounted in the outer pan directly on the power unit. This involves great difficulties. Besides, if the starter is externally disposed, great disturbances regarding the meshing of gears at the periphery of the flywheel must be expected.

It is an object of the invention to eliminate these disadvantages and to provide a reciprocating internal-combustion engine which is of the kind described first hereinbefore and which provides an adequate insulation against a transmission of structure-borne sound between the power unit and the outer pan, a simple sealing of the oil sump formed by the pan and a resilient reaction against the engine torque but permits of a simple taking of power from the engine in the conventional manner and of a provision of auxiliary machines arranged in the usual manner and affords additional advantages.

This object is accomplished according to the invention in that the power unit is provided at both ends with soundproofing supporting members which are coaxial with the crankshaft and center the power unit and hold it against substantial axial movement in the outer pan, and only an oil seal is fitted between the power unit and the top rim of the outer pan.

Because the power unit is centered in the outer pan by the soundproofing members, the power unit can rock only about the axis of the crankshaft but cannot swing so as to change the position of the center of the crankshaft. For this reason the ends of the crankshaft can extend out of the outer pan in conventional manner and be provided with simple seals there. The auxiliary machines can readily be arranged outside the pan and driven in the proved manner. Power can be taken from the engine by a clutch which is close to the flywheel and a separate intermediate flexible coupling is not required. Difficulties regarding the meshing of a starter pinion need not be expected. Because the preferably annular soundproofing members hold the power unit also against substantial axial movement, axial guide means are not required. There is no path for the transmission of structure-borne sound to the outer pan and the power unit is supported only by means of the soundproofing members. As a result, the outer pan and the parts connected to it are substantially insulated against structure-borne sound. This will be particularly desirable if a reciprocating internal-combustion engine according to the invention is used in a tractor or construction machine because in such case the outer pan constitutes a structural part of the tractor body. No structure-borne sound is transmitted, e.g., to the gearbox. Such transmission of structure-borne sound has previously resulted in a very disturbing noise in the cab of the tractor. Because the oil seal is not loaded by the weight of the power unit, a highly flexible oil seal may be used so that a transmission of structure-borne sound is virtually entirely precluded in this region too.

To avoid difficulties in assembling, particularly in view of the fact that both ends of the crankshaft protrude from the outer pan, the latter is divided in a plane transverse to the crankshaft.

The soundproofing members may consist of metal-clad rubber elements which comprise an inner ring secured to the power unit and an outer ring fixed in the outer pan. In that case the sound-insulating rings can also react against the engine torque so that the structural expenditure can be reduced.

If the soundproofing members consisting of metal-clad rubber elements should be particularly soft so that they provide an overcritical suspension in order to prevent a transmission of torque fluctuations to the outer pan, each soundproofing member has preferably associated with it a guide ring, which consists of a material that insulates against structure-borne sound and is disposed between the power unit and the outer pan with a slight radial clearance. Such guide ring will engage after an even small radial movement and will ensure an adequate centering of the crankshaft in the outer pan but does not promote the transmission of sound because it consists of a material which insulates against structure-borne noise. It will be understood that any soundproofing member consisting of a metal-clad rubber element may have progressive characteristic curves in the peripheral and radial directions if the configuration and material of the elastic part of the soundproofing member is properly selected.

According to a further feature of the invention, an oil-handling gear pump known per se and having an internal gear is disposed within at least one of the soundproofing members and comprises a housing which is fixed to the power unit. In that case there is no need for additional space for the oil pump and the expenditure required for the pump drive is eliminated. Generally radial passages are provided in the pump housing and soundproofing member and lead to and from an oil filter, which is mounted on the outer pan. Whereas the slight rocking of the axis of the crankshaft results in slight displacements of the mouths of the ports relative to each other at their interfaces, these displacements can easily be compensated if the cross-section of one of the passages at the interface is properly dimensioned. In any case, the oil conduits which are otherwise required on the outer pan and connect the power unit and the oil filter can be eliminated. Owing to the motion of the power unit such oil filters were previously subjected to high fatigue stresses so that they were liable to break. The externally arranged oil filter can be serviced more easily.

If the cylinders and cylinder heads of the reciprocating internal-combustion engine are integrated in a structural unit and the upper parts of the crankshaft bearings are screwed to said integral cylinders and cylinder heads, it will be particularly desirable to provide soundproofing members which are directly or indirectly secured to a structural unit constituted by the upper parts of the crankshaft bearings. If it is desired in such case to remove the structural unit comprising the cylinders and cylinder heads, e.g., for a remachining of the valve seats, it will be sufficient to remove the screws which hold the lower parts of the crankshaft bearings and connecting-rod bearings so that the structural unit can be lifted upwardly together with the pistons and connecting-rods whereas the structural unit comprising the upper parts of the crankshaft bearings remains in position because it is secured to the soundproofing members. In the known arrangements of this kind, e.g., in accordance with Opened German Specification No. 2,638,009, the entire power unit inclusive of the crankshaft and flywheel must be removed for a removal of the structural unit comprising the cylinders and cylinder heads. The integration of the crankshaft bearings in a structural unit increases also the overall rigidity of the power unit. In order to facilitate the loosening of the lower parts of the crankshaft bearings and connecting-rod bearings, the bottom of the outer pan is provided with openings through which the screws for the crankshaft bearings and connecting-rod bearings are accessible and these openings can preferably be jointly covered by an additional bottom pan.

The outer pan may be sealed at its top by any desired hollow-sectional seal or by a diagram seal. More preferably the coil seal consists of an inflatable flexible tube, which will ensure a snug contact on the opposite surfaces whereas the seal itself can be highly flexible.

According to a further preferred feature of the invention the flexible tube is divided into chambers which are sealed against each other approximately in the plane which is defined by the axes of the cylinders. In that case the oil seal which consists of a flexible tube can also react against the torque of the power unit because the air in the flexible tube cannot escape from the loaded side of the flexible tube into the relieved opposite side. The flexible tube may be provided with projecting buffers, which extend with a clearance between those surfaces of the power unit and the outer pan which engage the oil seal. When the flexible tube has been compressed on one side under a relatively high load which is due to the engine torque, the projecting buffers will then be engaged and will also be compressed on that side so that the reaction torque will increase progressively. That progression can be changed to match a desired characteristic curve if the projecting buffers taper downwardly into the outer pan.

In order to increase the sealing action and to reduce the machining expenditure, those surfaces of the power unit and the outer pan which engage by the oil seal may be left unmachined and coated with a sealing compound. Particularly if the seal consists of an inflatable flexible tube, it must be reliably held in position. This can be ensured and the sealing action can be improved if those surfaces of the power unit and of the outer pan which engage the oil seal are formed with a groove and the oil seal has a bulge received in said groove.

If the upper part of the power unit is shielded by a hood, the top portion of the oil seal may be profiled to receive the rim of such hood so that there is no need for a separate resilient support for the hood.

Figure 2:
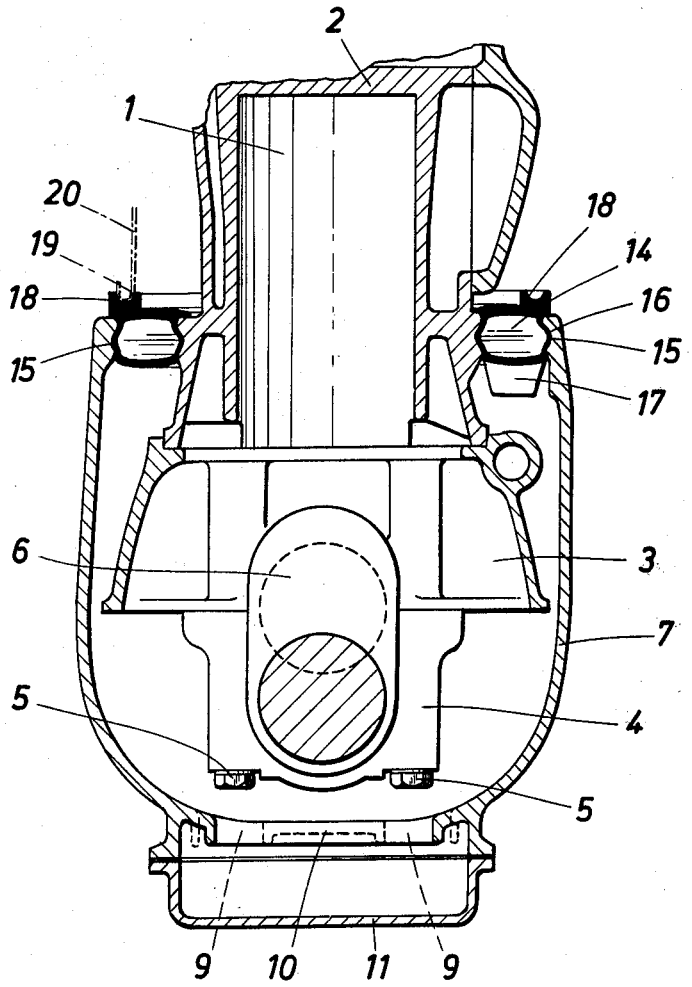

An embodiment of the invention is shown by way of example on the accompanying drawings, in which FIG. 1 is an axial sectional view showing those parts of a four-cylinder reciprocating internal-combustion engine which are essential for the invention and FIG. 2 is a transverse sectional view taken on line II—II in FIG. 1. The pistons and connecting-rods have been omitted.

Cylinders 1 and cylinder heads 2 are integrated in a structural unit, to which the upper parts 3 of the crankshaft bearings 3, 4 are connected by screws. These upper parts 3 of the crankshaft bearings form another structural unit. The lower parts 4 of the crankshaft bearings 3, 4 are connected by screws 5 to the structural unit formed by upper parts 3 and also to the structural unit consisting of the cylinders 1 and cylinder heads 2. The power unit consists of the cylinders 1, cylinder heads 2, crankshaft bearings 3, 4, a crankshaft 6 and connecting rods and pistons, which are not shown. Soundproofing supporting elements mount this power unit in an outer pan 7 which is integrally cast with a flywheel housing 8. A bottom portion of the outer pan 7 defines openings 9, 10, through which the screws 5 for the crankshaft bearings 3, 4 and the screws for the connecting-rod bearings are accessible. These openings 9, 10 are covered by an additional bottom pan 11. The outer pan 7 is separable along plane E extending transversely to the crankshaft so that the completely preassembled power unit can be inserted into the outer pan.

The power unit is provided at both ends with soundinsulating members which are coaxial with the crankshaft 6 and consist of insulating rings 12, **12*a* and 13 made of a soundproof material and serve also as supporting elements for centering and axially locating the power unit in the outer pan 7. The insulating ring 12*a* holds the power unit against axial movement, except for any minor movement caused by the elasticity of the ring material. An oil seal consisting of an inflatable flexible tube 14 is disposed between the upper rim of the outer pan 7 and the structural unit which comprises the cylinders 1 and the cylinder heads 2 of the power unit. Those surfaces of the outer pan 7 and of the structural unit 1, 2 of the power unit and which engage the oil seal consisting of the flexible tube 14 are formed with a groove 15, in which a bulge 16 of the oil seal 14 is received. The oil seal consisting of the flexible tube 14 is provided with projecting buffers 17 which extend into the outer pan 7 and are tapered downwardly. The tube 14 has a profiled top portion 18 which receives the rim 19 of a cover 20** for the power unit. That cover is indicated in phantom.

At the right-hand end of the power unit in FIG. 1, an oil-handling gear pump is disposed radially inwardly of the sound-insulating ring 13 and consists of a housing 21, an internal gear 22 and a pinion 23. The sound-insulating ring 12 is directly connected by screws to the structural unit which comprises the upper parts 3. The sound-insulating ring 13 is indirectly secured to said structural unit through the intermediary of the housing 21 of the oil-handling gear pump.

What is claimed is:

1. An internal combustion engine comprising (a) a power unit including a plurality of cylinders and associated cylinder heads, crankshaft bearings connected to the cylinders and a crankshaft rotatably mounted in the bearings, the crankshaft having two ends, (b) an outer pan having a bottom and an upper rim, the outer pan carrying the power unit and the power unit being mounted in the outer pan with a portion of the power unit protruding above the upper rim of outer pan, the protruding power unit portion and the upper rim defining a space therebetween, (c) a flywheel housing connected to the outer pan beyond one of the crankshaft ends, (d) annular soundproofing, load-bearing supporting members mounted coaxially about the crankshaft bearings near the ends of the crankshaft, the supporting members being arranged to support and center the power unit with respect to the outer pan and to hold the power unit against substantial axial movement in the outer pan, and (e) an oil seal mounted in the space between the protruding power unit portion and the outer pan upper rim for sealing in an oil-tight manner the power unit in the outer pan.

2. The internal combustion engine of claim 1, wherein the outer pan consists of two coaxial parts, the pan parts being separable along a plane extending transversely to the crankshaft.

3. The internal combustion engine of claim 1, further comprising an oil handling gear pump disposed radially inwardly of one of the supporting members, the gear pump including an internal gear and a housing fixed to the power unit and containing the gear.

4. The internal combustion engine of claim 1, wherein the cylinders and associated cylinder heads constitute a structural unit, the crankshaft bearing parts constituting a structural unit, the structural units are secured together by screw-means, the supporting members being secured to the structural unit constituted by the upper crankshaft bearing parts.

5. The internal combustion engine of claim 4, wherein the bottom of the outer pan defines openings wherethrough the screw means are accessible, and further comprising a bottom pan mounted on the bottom for covering the openings.

6. The internal combustion engine of claim 1, wherein the oil seal is an inflatable flexible tube.

7. The internal combustion engine of claim 6, wherein the protruding power unit portion and the upper rim have respective surfaces tightly engaged by the flexible tube, and the tube has buffer elements projecting into the outer pan and tapering downwardly from the tube.

8. The internal combustion engine of claim 7, wherein the respective surfaces define grooves and the flexible tube has bulges conforming to, the extending into, the grooves.

9. The internal combustion engine of claim 1, wherein the oil seal has a profiled top portion extending above the upper rim of the outer pan, and further comprising a hood disposed over the protruding power unit portion, the hood having a lower rim received in the profiled top portion of the oil seal.

* * * * *